US008469474B2

(12) United States Patent
Nakazawa et al.

(10) Patent No.: US 8,469,474 B2
(45) Date of Patent: Jun. 25, 2013

(54) PRINTING APPARATUS AND PRINTING METHOD

(75) Inventors: Koichiro Nakazawa, Machida (JP); Hideaki Takamiya, Yokohama (JP); Noribumi Koitabashi, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 483 days.

(21) Appl. No.: 12/797,838

(22) Filed: Jun. 10, 2010

(65) Prior Publication Data

US 2010/0328387 A1 Dec. 30, 2010

(30) Foreign Application Priority Data

Jun. 24, 2009 (JP) ..... 2009-150074

(51) Int. Cl.
*B41J 29/38* (2006.01)

(52) U.S. Cl.
USPC ..... 347/14

(58) Field of Classification Search
USPC ..... 347/14
See application file for complete search history.

(56) References Cited

U.S. PATENT DOCUMENTS

| | | | | |
|---|---|---|---|---|
| 5,633,663 | A | 5/1997 | Matsubara et al. | |
| 5,696,542 | A | 12/1997 | Matsubara et al. | |
| 5,992,972 | A | 11/1999 | Nagoshi et al. | |
| 6,130,685 | A | 10/2000 | Matsubara et al. | |
| 6,250,737 | B1 | 6/2001 | Matsubara et al. | |
| 2003/0007024 | A1 * | 1/2003 | Fujimori | 347/15 |

FOREIGN PATENT DOCUMENTS

| | | | |
|---|---|---|---|
| JP | 2006150811 | A | 6/2006 |
| JP | 2006168241 | A | 6/2006 |
| JP | 2006188051 | A | 7/2006 |
| JP | 2006231736 | A | 9/2006 |

* cited by examiner

*Primary Examiner* — Laura Martin
(74) *Attorney, Agent, or Firm* — Fitzpatrick, Cella, Harper & Scinto

(57) ABSTRACT

Each of four areas of 2×2 in one pixel has four sub areas and the four sub areas correspond to four nozzle arrays A to D. In the sub area of each area, information showing what nozzle array is used for a print of the area is defined. The sub area filled in black shows performing therein a print of a dot using nozzles in the nozzle array corresponding to the sub area. In this way, the dot arrangement pattern has information showing the nozzle array to which nozzles used for printing an area belong, for each area. Therefore, without executing the particular data allocation processing such as mask processing, the allocation of the dot data to the plurality of nozzle arrays can be carried out with a simple arrangement.

8 Claims, 14 Drawing Sheets

PRINTING APPARATUS AND PRINTING METHOD

BACKGROUND OF THE INVENTION

1. Field of the Invention

The present invention relates to a printing apparatus and a printing method, and particularly to allocation of print data to plurality of arrays of printing element such as a nozzle, or plurality of times of scans of a print head in a case that printing of one color is performed by the plurality of printing element arrays or the plurality of times of scans.

2. Description of the Related Art

Conventionally the allocation of the print data to plurality of nozzle arrays or plurality of nozzles is well known in multi-pass printing by a so-called serial type printing apparatus in which a print head scans an area of a predetermined size multiple times to complete printing of that area. For example, the allocation of the print data is performed to reduce a phenomenon of degrading quality of a print image, which is called "overflow" or "beading". Here, "overflow" or "beading" means a phenomenon that ink droplets land in neighboring positions to be united therein, thus producing a clump of the ink droplets. When such large clump of the ink droplets is absorbed in a print medium, the clump is recognized as a relatively large dot in the printed image, bringing in image degradation such as grainy feeling.

Japanese Patent Laid-Open No. 2006-150811 describes a known arrangement for overcoming such "overflow" problem, in a so-called full line type inkjet printing apparatus. The full line type printing apparatus uses a print head in which nozzles are arrayed in a range corresponding to a width of a print medium to be conveyed. In addition, the print medium is conveyed to cause the nozzle array to be opposed to a print area of the print medium, and ink is then ejected from each nozzle to perform printing of one line. The processes are sequentially repeated to perform printing of a predetermined area of the print medium. Japanese Patent Laid-Open No. 2006-150811 describes a print head in which a plurality of such nozzle arrays are provided for one color of ink and the respective nozzle arrays of the plurality of nozzle arrays are shifted with each other in the nozzle array direction. The allocation of the print data to each nozzle array, that is, the nozzle array used for a print of each line is determined so that nozzles in the same nozzle array are not used adjacently in the conveying direction of the print medium. Consequently, for example, the nozzle for printing a pixel in the print image can belong to a nozzle array different from nozzle arrays including nozzles for printing eight pixels adjacent to the pixel in the upper-lower, right-left and slant directions. That is, the ink ejections from the eight pixels in the vicinity of the pixel are performed at timing different from that of ink ejection of the pixel. In consequence, it can reduce a possibility that "overflow" occurs caused by joining of the inks of the adjacent pixels.

The control in which the plurality of nozzle arrays are used in regard to one color and the print data are allocated to these nozzle arrays is, as described in Japanese Patent Laid-Open No. 2006-150811, relatively easy to perform in a case of the print head where the respective nozzles of the plurality of nozzle arrays are displaced from each other in the nozzle array direction. That is, as a result of the displaced nozzle arrangements, simply by determining the use order of the nozzle arrays, the allocation of the print data which is capable of reducing the joining between ink of a pixel and inks landing in eight pixels adjacent to that pixel can be made. However, even in a case of using usual nozzle arrays of which the nozzles are not displaced, by appropriately performing the allocation of the print data, for example, the joining between ink of a pixel and inks landing in eight pixels adjacent to that pixel can be reduced in the same way with Japanese Patent Laid-Open No. 2006-150811.

Incidentally, there is known an example of the print data generation in which multi-valued image data are quantized to image data having lower gradation level numbers and an arrangement pattern (dot arrangement pattern) of binary data is allocated to each gradation level of the quantized image data. In addition, in the above multi-pass print, mask processing is executed to the binary data pattern developed by the dot arrangement pattern to generate the print data for each nozzle of each scan.

In the full line type printing apparatus, however, in a case of performing printing by using plurality of nozzle arrays in regard to one ink color as described above, it is difficult to allocate the binary data developed by the dot arrangement pattern to the plurality of nozzle arrays, based upon the mask processing. More specifically, depending on the gradation level, there exists possible arrangement of binary data in such a manner as to eject ink from nozzles of different nozzle arrays at the same position (in such a manner as to overlap two or more dots). In this case, the data allocation can not be basically carried out by the mask processing.

SUMMARY OF THE INVENTION

An object of the present invention is to provide a printing apparatus and a printing method which can carry easily out allocation of print data to plurality of printing element arrays or plurality of times of scans of a print head in a case of performing printing of one color by the plurality of printing element arrays or the plurality of times of the scans of the print head.

In a first aspect of the present invention, there is provided a printing apparatus that performs printing by carrying out a relative movement between printing elements for forming dots on a print medium and the print medium, said apparatus comprising: a relative movement unit configured to carry out the relative movement so as to make the printing elements opposed to a same pixel area of the print medium, on which a dot is formed, plurality of times, different printing elements being sequentially opposed to the same pixel area; and a dot data generation unit configured to generate dot data by using a dot arrangement pattern that determines whether or not to form dots for each pixel area and holds information on a printing element of the different printing elements, which forms the dot on a pixel area, correspondingly to said pixel area.

In a second aspect of the present invention, there is provided a printing apparatus that performs printing by carrying out a relative movement between printing elements for forming dots on a print medium and the print medium, said apparatus comprising: a relative movement unit configured to carry out the relative movement so as to make the printing elements opposed to a same pixel area of the print medium, on which a dot is formed, plurality of times, the plurality of times of the relative movements making a printing element opposed to the same pixel area; and a dot data generation unit configured to generate dot data by using a dot arrangement pattern that determines whether or not to form dots for each pixel area and holds information on a relative movement of the plurality of times of the relative movements, which forms the dot on a pixel area, correspondingly to said pixel area.

In a third aspect of the present invention, there is provided a printing method for performing printing by carrying out a relative movement between printing elements for forming dots on a print medium and the print medium, said method comprising: a step of preparing a relative movement unit configured to carry out the relative movement so as to make the printing elements opposed to a same pixel area of the print medium, on which a dot is formed, plurality of times, different printing elements being sequentially opposed to the same pixel area; and a dot data generation step of generating dot data by using a dot arrangement pattern that determines whether or not to form dots for each pixel area and holds information on a printing element of the different printing elements, which forms the dot on a pixel area, correspondingly to said pixel area.

In a fourth aspect of the present invention, there is provided a printing system that performs printing by carrying out a relative movement between printing elements for forming dots on a print medium and the print medium, said system comprising: a relative movement unit configured to carry out the relative movement so as to make the printing elements opposed to a same pixel area of the print medium, on which a dot is formed, plurality of times, different printing elements being sequentially opposed to the same pixel area; and a dot data generation unit configured to generate dot data by using a dot arrangement pattern that determines whether or not to form dots for each pixel area and holds information on a printing element of the different printing elements, which forms the dot on a pixel area, correspondingly to said pixel area.

According to the present invention, it is possible to carry easily out allocation of print data to plurality of printing element arrays or plurality of times of scans of a print head in a case of performing printing of one color by the plurality of print element arrays or the plurality of rimes of the scans of the print head.

Further features of the present invention will be become apparent from the following description of exemplary embodiments (with reference to the attached drawings).

DESCRIPTION OF THE EMBODIMENTS

Hereinafter, embodiments of the present invention will be in detail explained with reference to the accompanying drawings.

First Embodiment

Figure 1:
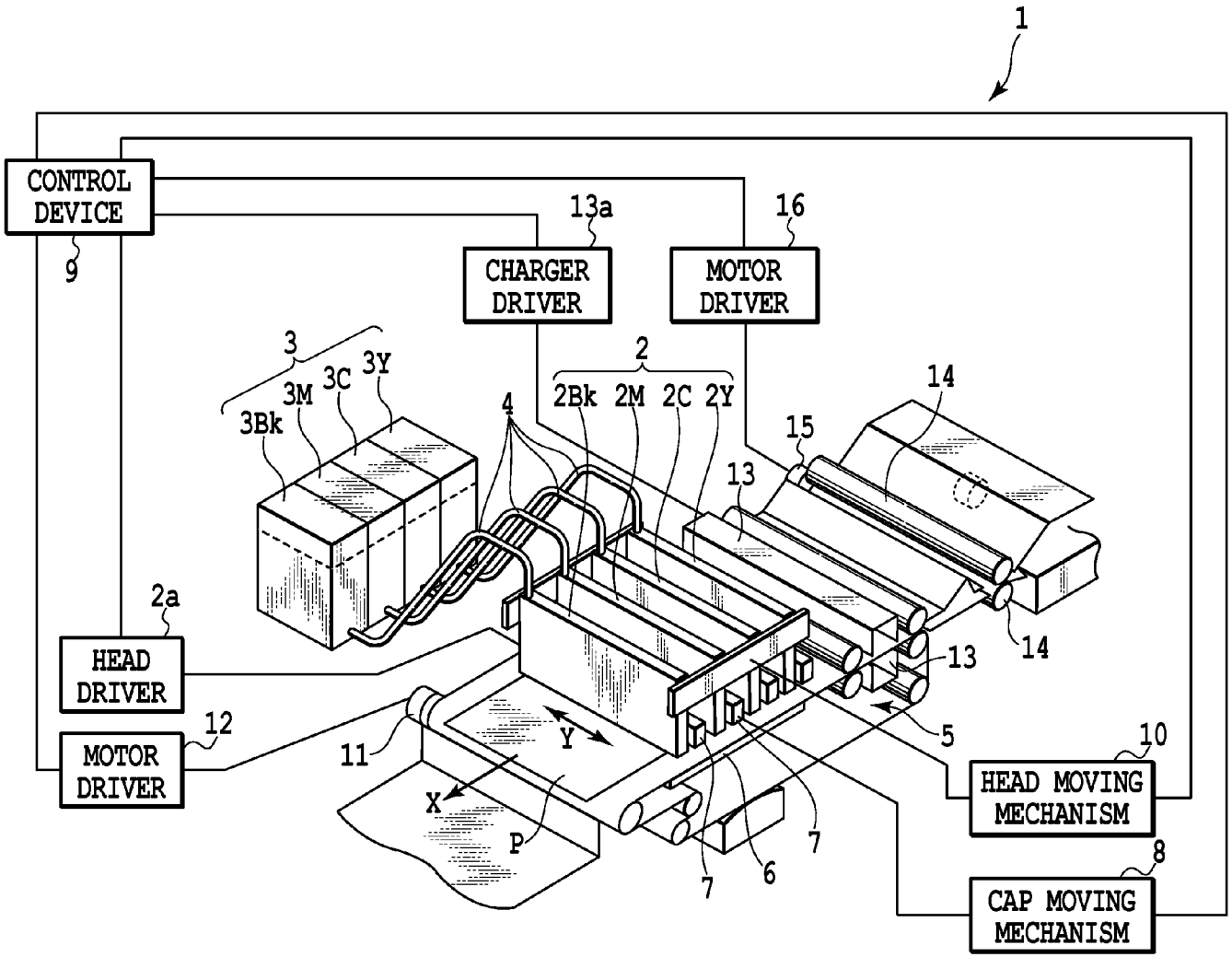
FIG. 1 is a diagram showing a schematic arrangement of an inkjet printing apparatus according to a first embodiment of the present invention.
Figure 2:
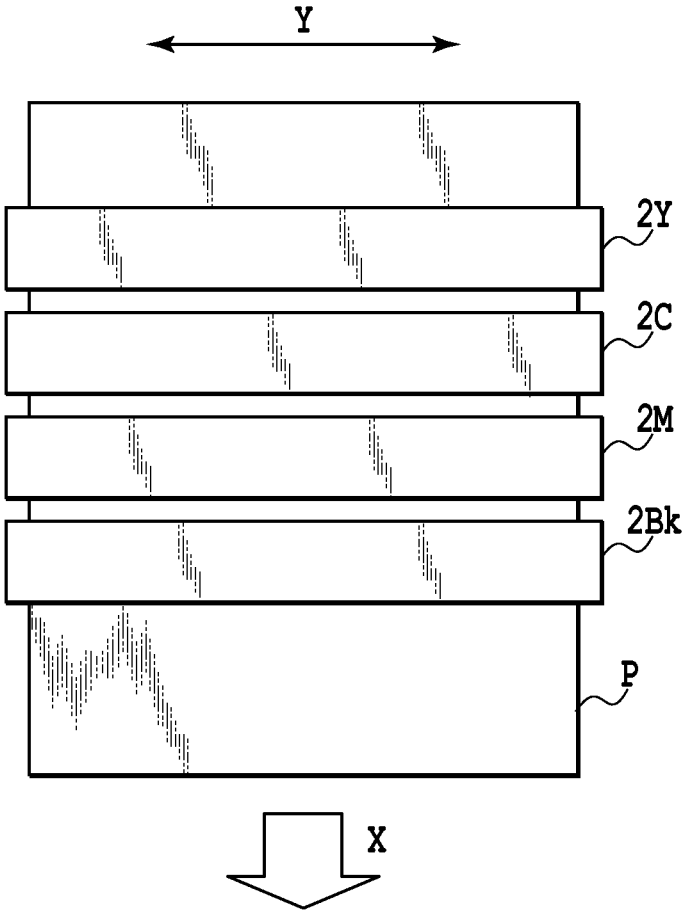
FIG. 2 is a plan pattern diagram showing an array of print heads used in the inkjet printing apparatus.

FIG. 1 is a diagram showing a schematic arrangement of an inkjet printing apparatus according to a first embodiment of the present invention, and FIG. 2 is a plan view showing an array of print heads. An inkjet printing apparatus 1 in the present embodiment is a full line type printing apparatus in which longitudinal print heads 2Y, 2M, 2C and 2Bk extending in a direction perpendicular to a conveying direction (hereinafter, also called main scan direction) of a print medium are arranged in parallel with each other. Here, reference sign 2Y denotes a print head ejecting yellow ink, reference sign 2M denotes a print head ejecting magenta ink, reference sign 2C denotes a print head ejecting cyan ink, and reference sign 2Bk denotes a print head ejecting black ink. The respective print heads have the substantially same arrangement and in the following explanation, they are collectively denoted as a print head 2 in a case where it is not necessary to designate each of them particularly. Further, the print head of each color, as described later in FIG. 4, has four nozzle arrays. Each print head 2 is connected through a connecting pipe 4 to each of ink tanks 3Y, 3M, 3C and 3Bk (hereinafter, collectively called ink tank 3) respectively reserving yellow ink, magenta ink, cyan ink and black ink therein. These ink tanks 3 are mounted to the connecting pipes 4 to be removable thereto.

The print heads 2 can go up and down in a direction opposing a platen 6 by head moving mechanism 10, an operation of which is controlled by a control device 9, for recovery processing. The print heads 2 oppose the platen 6 so as to put an endless conveying belt 5 between the print heads 2 and the platen 6 and are arrayed by a predetermined interval along a conveying direction by the conveying belt 5. The print head 2 is provided with ink ejection openings (nozzles) for ejecting ink, a common liquid chamber for once reserving ink from the ink tanks 3, and ink flow passages for introducing ink to the respective ejection openings from the common liquid chamber. In each ink flow passage, an electro-thermal transducer (heater) as an ejection energy generating element generating thermal energy for ejecting ink supplied thereto is provided to correspond to the ejection opening. Each heater is driven by a head driver 2*a*, which is connected electrically to a control device 9. A drive of the heater is controlled by an ON/OFF signal (ejection/non-ejection signal) sent from the control device 9.

A head cap 7 is provided in a side of the each print head 2, and with this cap 7, viscosity-increased ink or the like which may exist in the ink flow passage or the like can be discharged from the ejection opening of the print head 2 to execute the recovery processing of the print head. The head cap 7 is arranged to be shifted by a half pitch of the array interval between the print heads and can be moved directly under each print head 2 by cap moving mechanism 8 driven by the control device 9. Therefore, the head cap 7 can receive the waste ink discharged from the ink ejection openings.

The conveying belt 5 for conveying a print medium P is wound around a drive roller connected to a belt driving motor 11. An operation of the conveying belt 5 is switched by a motor driver 12 connected to the control device 9. A charger 13 is provided in the upstream side of the conveying belt 5, which can charge the conveying belt 5 to establish close contact between the print medium P and the conveying belt 5. Power of the charger 13 can be switched on/off by a charger driver 13*a* connected to the control device 9. A pair of feeding rollers 14 and 14 feed the print medium P onto the conveying belt 5. A feeding motor 15 for rotating the rollers 14 and 14 is connected thereto and the feeding motor 15 is switched in operation by a motor driver 16 connected to the control device 9.

In the above printing apparatus, in performing a printing operation to the print medium P, first, each print head 2 goes up to leave away from the platen 6, and next, the head cap 7 moves directly under each print head 2 to execute the recovery processing. Thereafter, the head cap 7 moves back to the original stand-by position. After that, the print head 2 further moves to a print position in a platen side. Then, the charger 13 is operated, simultaneously the conveying belt 5 is driven, the print medium P is further fed to the conveying belt by the feeding rollers 14 and 14, and a color image is printed on the print medium P by ink ejected from each print head 2.

It should be noted that the inkjet printing system to which the present invention is applicable is not limited to a so-called bubble jet system using the heater as shown in FIGS. 1 and 2. For example, in a case of a continuous type continuously ejecting ink droplets, a charge control type system and a dispersion control type system may be applied. In addition, in a case of an on-demand type ejecting ink droplets as needed, a pressure control type system ejecting ink by mechanical vibrations of a piezo vibration element may be applied.

Figure 3:
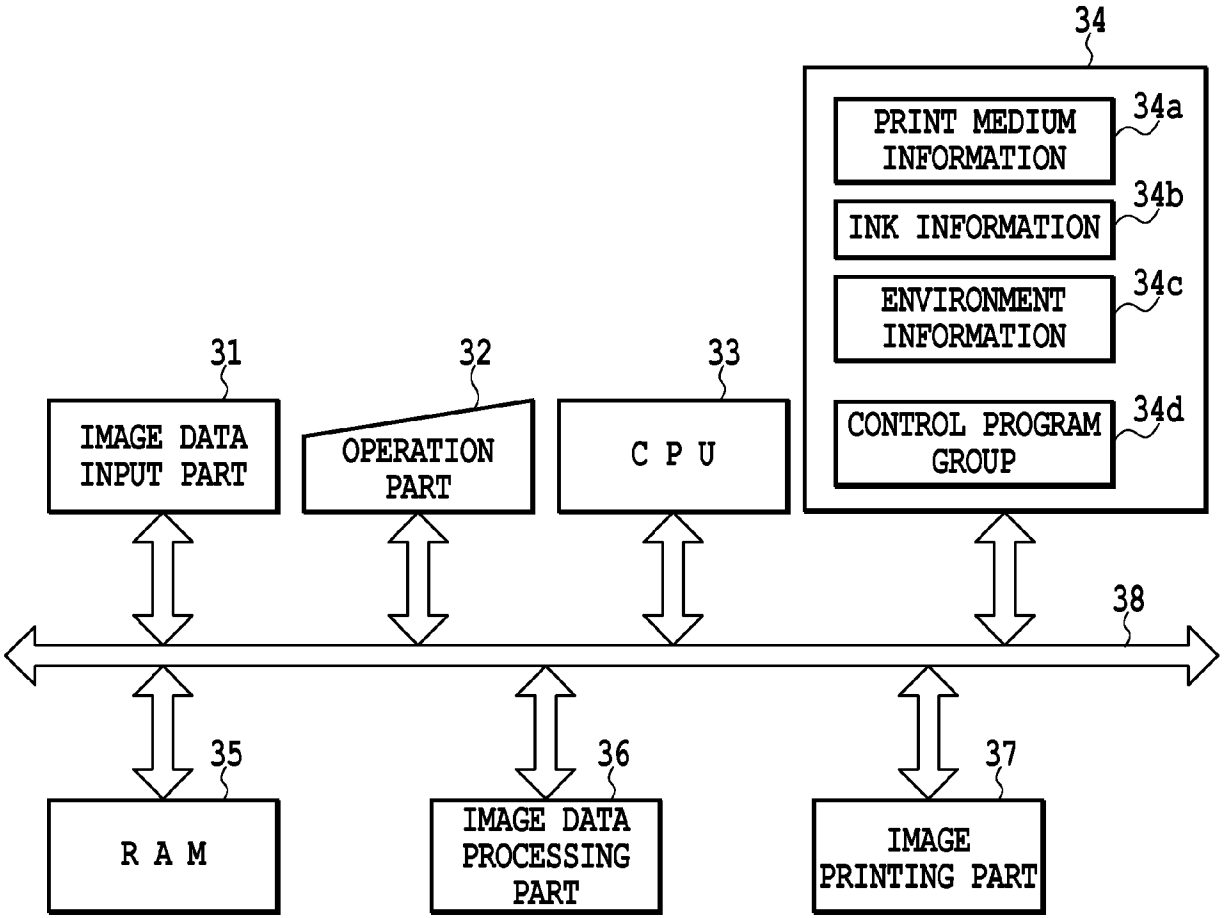
FIG. 3 is a block diagram showing an arrangement of a control system in the inkjet printing apparatus.

FIG. 3 is a block diagram showing a configuration of a control system of the aforementioned inkjet printing apparatus. In FIG. 3, reference numeral 31 denotes an image data input part for inputting multi-valued image data from an image input device such as a digital camera or multi-valued image data stored in a hard disc of a personal computer or the like. Reference numeral 32 denotes an operation part provided with various keys for setting various parameters and instructing a print start, and reference numeral 33 denotes a CPU as a control unit for controlling an entirety of the present printing apparatus according to the various programs in a storage medium. Reference numeral 34 denotes a memory unit for storing various data. The memory unit 34 includes a print medium information storing part 34*a* in regard to the kind of the print medium, an ink information storing part 34*b* in regard to ink, an environment information storing part 34*c* for storing information in regard to an environment such as a temperature and a humidity at printing, a various-control program group storing part 34*d*, and the like. Further, reference numeral 35 shows a RAM used as a work area of various programs in the memory unit 34, a temporal saving area at error processing, and a work area at image processing. Operations in the present embodiment are performed by the processing according to programs. Examples of the memory unit 34 for storing the program may include a ROM, a FD, a CD-ROM, a HD, a memory card, an optical magnetic disc and the like. In addition, after the RAM 35 copies various tables in the memory unit 34, in the RAM 35, the content of the copied table may be changed and the image processing while referring to the changed table.

Reference numeral 36 denotes an image data processing part, which quantizes an inputted multi-valued image data to a N-valued image data for each pixel and generates a pattern (dot pattern) of binary data corresponding to a gradation level "K" shown by each pixel quantized. This processing will be described later by referring to FIG. 6 or the like. It should be noted that the N-valued processing of the input multi-valued image data is executed by using an error diffusion process in the present embodiment but it is not limited thereto, and it may be executed by using an arbitrary halftone method such as an average density preserving method and a dither matrix method. Reference numeral 37 denotes an image printing unit for ejecting ink based upon the dot pattern generated in the image data processing part 36 to form a dot image on the print medium. This image printing unit has the mechanism shown in FIGS. 1 and 2. Reference numeral 38 denotes a bus line for transmitting address signals, data, control signals and the like in the printing apparatus.

Figure 4B:
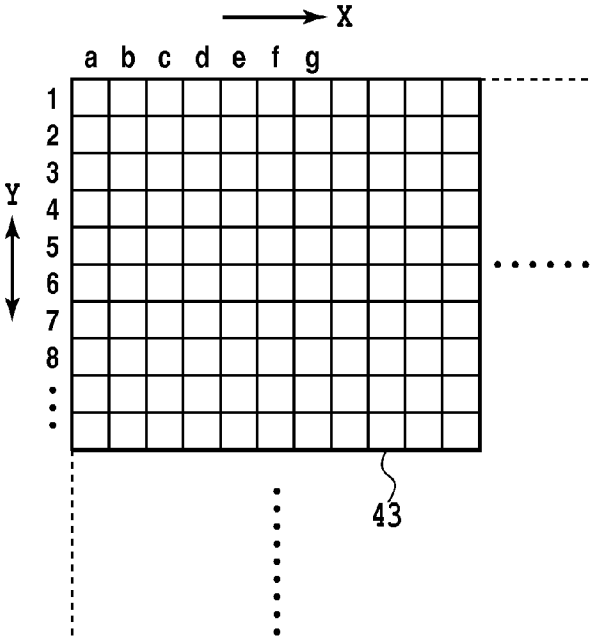
FIG. 4B is a diagram showing allocation of pixel areas corresponding to the above nozzle arrangement.
Figure 4A:
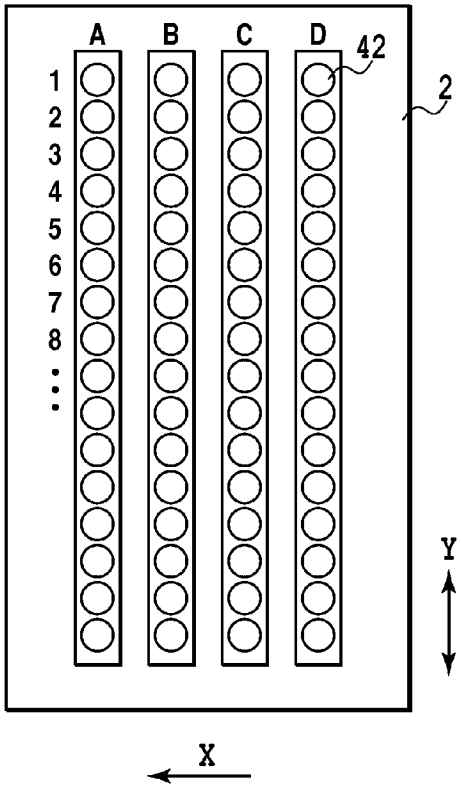
FIG. 4A is a diagram showing a nozzle arrangement in the print head corresponding to one ink color shown in FIGS. 1 and 2.

FIG. 4A is a diagram showing an nozzle arrangement in the print head corresponding to one ink color (print color) shown in FIGS. 1 and 2, and FIG. 4B is a diagram showing the arrangement of pixel areas corresponding to the nozzle arrangement.

As shown in FIG. 4A, the print head 2 corresponding to one ink color includes four arrays (A array to D array) in each of which 960 pieces of nozzles 42 each ejecting ink having an ejection amount of 2.8 pl are arranged substantially in one line by an interval corresponding to 1200 dpi (interval of substantially 21.2 μm). In this figure, reference sign X denotes a conveying direction (main scan direction) of the print medium and reference sign Y denotes a nozzle array direction intersecting with the conveying direction.

In the full line type printing apparatus in the present embodiment, in regard to each ink color, the ink is ejected from each nozzle 42 of the four nozzle arrays A, B, C and D of the print head 2 according to print data, for performing printing to the print medium conveyed in the X direction relative to the print head. As shown in FIG. 4B, the pixel areas defined on the print medium on which ink is ejected from the nozzle for landing are arrayed with resolution of 1200 dpi in the direction Y which is the same as the resolution in the nozzle array and likewise resolution of 1200 dpi in the X direction (main scan direction). A matrix 43 of the pixel areas is configured with the above resolutions. A binary data (dot data) is, as described later in FIGS. 6A and 6B, generated corresponding to each pixel area in the matrix. In the matrix 43, numbers 1, 2, 3, and so forth are attached to the respective raster of the pixel areas, and signs a, b, c, and so forth can be attached to the respective columns of the pixel areas to specify the pixel area in the matrix. That is, the pixel area can be expressed with (1, a), (2, c) and so forth and thus can be specified. In a specific printing operation, the print medium is conveyed, and followed by it, in FIG. 4B, ink is ejected to corresponding pixel areas in the order of the columns a, b, c, . . . from the nozzles of the nozzle array to which the print data are allocated.

Figure 5:
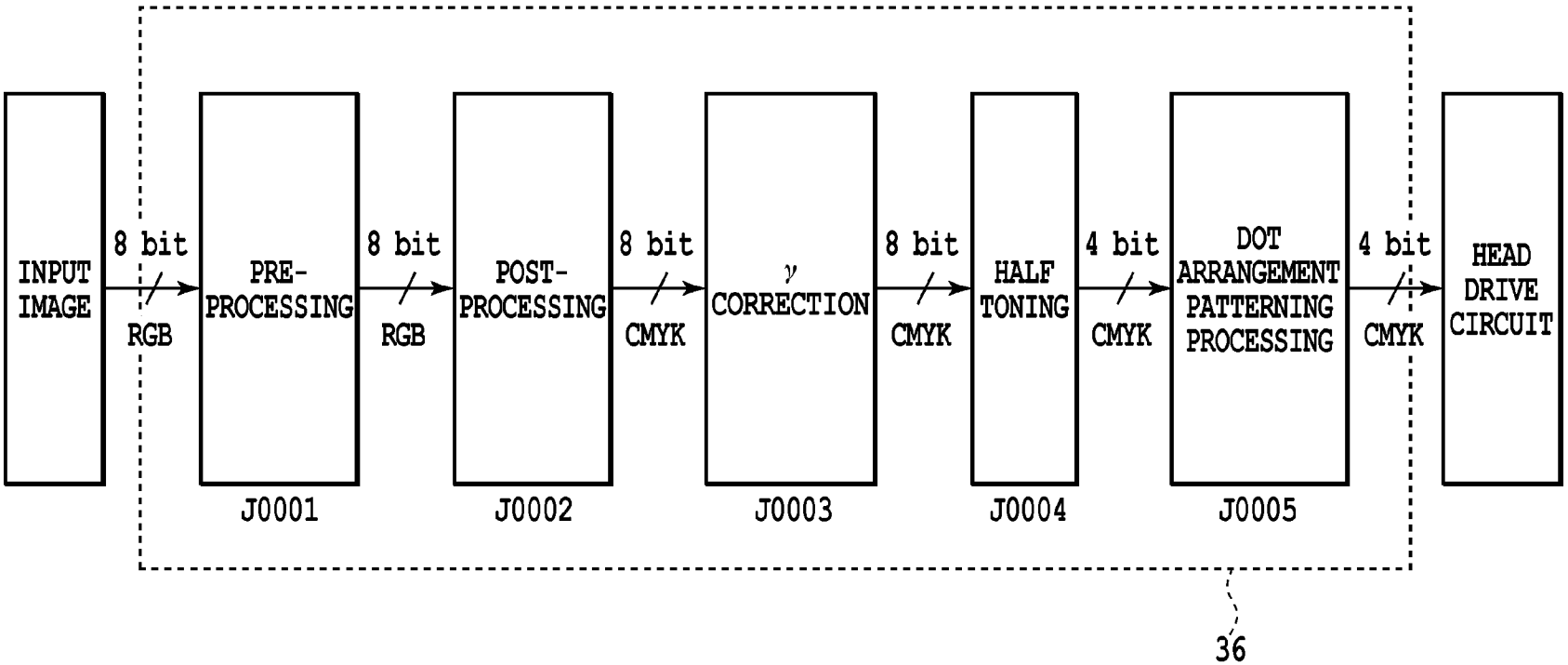
FIG. 5 is a block diagram showing a detail of the processing in an image data processing part explained in FIG. 3.

FIG. 5 is a block diagram showing a detail of the processing of the image data processing part 36 explained in reference to FIG. 3. This processing, as shown in FIG. 5, includes pre-processing J0001, post-processing J0002, γ correction processing J0003, half toning processing J0004, and dot arrangement patterning processing J0005.

The pre-processing J0001 performs mapping of color gamut. The pre-processing J0001 performs data conversion for mapping the color gamut reproduced by image data of R, G and B of the sRGB standard to the color gamut reproduced by the printing apparatus in the present embodiment. Specifically the data in which each of R, G and B is expressed by eight bits is converted into each eight-bit data of R, G and B having a different content by using a three-dimensional LUT.

The post-processing J0002, based upon the mapped data of R, G and B in the above color gamut, executes the processing of finding color separation data of Y, M, C and K corresponding to a combination of ink reproducing a color expressed by the data of R, G and B. Here, in the same way with the pre-processing, the processing is executed by use of an interpolation calculation together with the three-dimensional LUT. The γ correction processing J0003 performs the gradation value conversion for each data of each color of the color separation data found by the post-processing J0002. Specifically by using a one-dimensional LUT corresponding to a gradation characteristic of each color ink in the printing apparatus, the γ correction processing J0003 performs the conversion in such a manner that the above color separation data can correspond linearly to the gradation characteristic in the printing apparatus. The half toning processing J0004 performs quantization in which each of the color separation data of Y, M, C and K each having eight bits is converted into each data of four bits. In the present embodiment, eight-bit data of 256 gradations are converted into four-bit data of nine gradations with resolution of 600 dpi by using the error diffusion method. These four-bit data are, as described in FIGS. 6A and 6B, data serving as an index for showing an arrangement pattern in the patterning processing in the dot arrangement in the printing apparatus.

Next, there will be executed the dot arrangement patterning processing J0005. In the aforementioned half toning processing, the multi-valued density information of 256 values (eight-bit data) is reduced in level number to the gradation value information of nine values (four-bit data). However, the information according to which inkjet printing apparatus in the present embodiment can print is binary information on whether to print ink or not. The dot arrangement patterning processing serves to reduce the multi-valued levels of 0 to 8 to the binary level for determining presence/absence of the dot. Specifically in the dot arrangement patterning processing J0005, for each pixel expressed by four-bit data of the levels of 0 to 8 as output values from the half toning processing unit, a dot arrangement pattern corresponding to gradation values (gradation levels of 0 to 8) of the pixel is determined. On this occasion, as described later in FIGS. 6A and 6B, in regard to each color, a bit number corresponding to the nozzle array number is assigned to one area in the dot arrangement pattern for expressing nine gradations of the levels of 0 to 8 to match each bit to each nozzle array one to one. In the present embodiment, since one ink color has four nozzle arrays, four bits are assigned to one area in the dot arrangement pattern, and thus A array, B array, C array and D array are assigned to one area from the highest-order bit. One area of such dot arrangement pattern can provide data for ejecting any of 0 to four droplets as the ink droplet. As a result, it is possible to associate a binary data (dot data) of one bit of "1" or "0" determining presence/absence of the dot with each nozzle in the nozzle array.

Figure 6A:
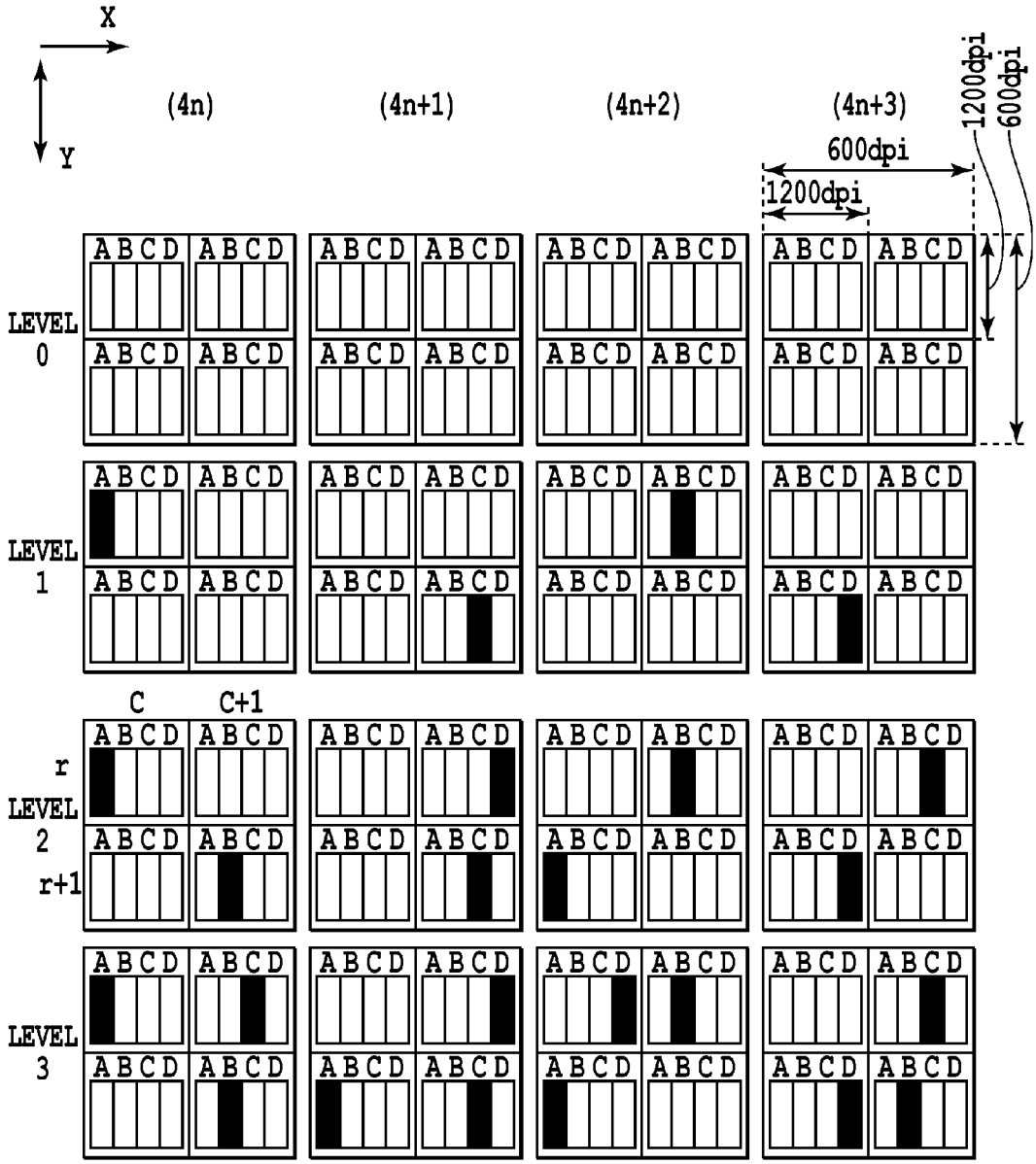
FIGS. 6A and 6B are diagrams showing dot arrangement patterns according to the first embodiment of the present invention.
Figure 6B:
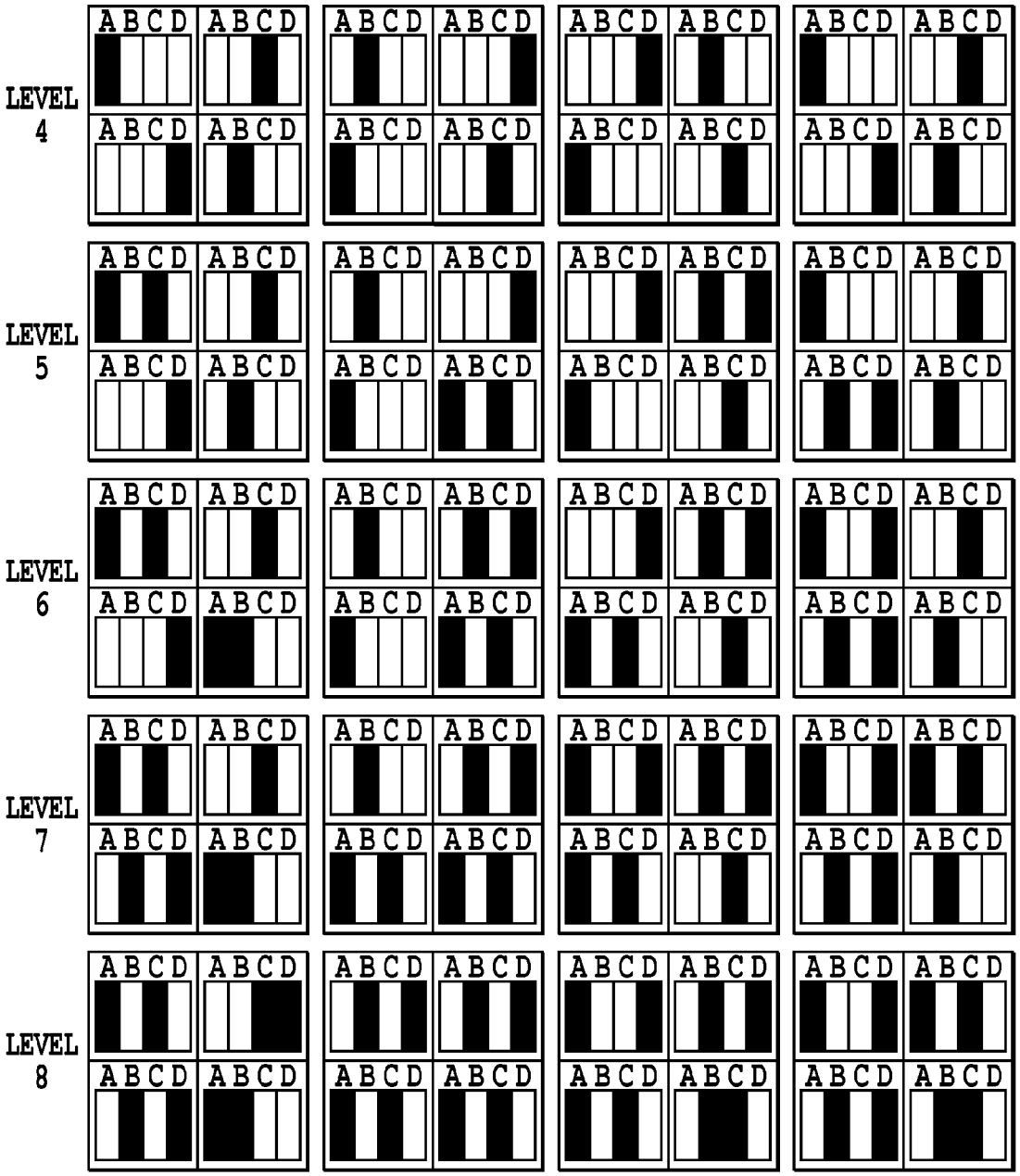

FIGS. 6A and 6B are diagrams showing dot arrangement patterns used in the aforementioned dot arrangement patterning processing J0005, and specially shows the dot arrangement patterns corresponding to the gradation levels of 0 to 8 shown by the four-bit data as input to the dot arrangement patterning processing J0005.

In FIGS. 6A and 6B, each level value of 0 to 8 shown in the left side of each pattern shows an output value from the half toning processing part J0004. Each of sections configured by vertical two areas×lateral two areas, which are shown in the right side of the level value, corresponds to an area of one pixel of the output data of the half toning processing part, and the vertical and lateral sizes of each section correspond to resolution of 600 dpi. Each of the four areas of the two×two areas in one pixel has four sub areas, which correspond to the four nozzle arrays. In each of the sub areas, ON/OFF in the corresponding nozzle array is defined. That is, the sub area of each area defines therein information showing what nozzle array is used for printing the area. Specifically the sub area filled in black means performing a print of a dot using nozzles in the nozzle array corresponding to the area. For example, in a case where "level 2" is inputted and a dot arrangement pattern shown in (4n) is used, in the area (corresponding to the pixel area shown in FIG. 4) shown by (r, c) shown in FIG. 6A, nozzles in the nozzle array of A array are used to form one dot therein. Likewise in the area shown by (r+1, c+1), nozzles in the nozzle array of B array are used to form one dot therein. In addition, in the areas (r, c+1) and (r+1, c), dots are not formed. Further, as in "level 5" and the subsequent levels, in the area having two sub areas filled in black, nozzles in two nozzle arrays shown in the sub areas are used to form two dots therein.

The dot arrangement pattern in the present embodiment holds information (nozzle array designating information) showing the nozzle array including a nozzle used for printing an area, for each area of the dot arrangement pattern, as described above. That is, the arrangement of the dot is defined for each sub area corresponding to the nozzle array. In consequence, without a special data allocation processing such as mask processing, the allocation of the dot data to the plurality of nozzle arrays can be performed with a simple arrangement.

One area composed of four sub areas as described above corresponds to the resolution of 1200 dpi in the vertical direction and the resolution of 1200 dpi in the lateral direction, and corresponds to the pixel area shown in FIG. 4B. The printing apparatus in the present embodiment is designed such that one to four ink droplets each having 2.8 pl can be ejected to one area expressed in a vertical length of about 21 μm and a lateral length of about 21 μm corresponding to the above resolution. That is, each area can be associated to the pixel area through a combination of the column sign and the raster number shown in FIG. 4B to use the above information of each area as the dot data.

In FIG. 6A, positions of the pixel areas in the image data in a lateral direction from the left end can be shown by substituting one or more integral numbers to n in signs (4n) to (4n+3). In addition, the respective dot arrangement patterns shown under the signs show that in the same gradation level, there are prepared the plurality of patterns which differ depending on a position of the pixel area. That is, even in a case where the same gradation level is inputted, the four kinds of the dot arrangement patterns shown by (4n) to (4n+3) are circulated and allocated on the print medium. Therefore, it is possible to obtain various effects, for example, that the ejection number is dispersed into the nozzles positioned at the upper step of the dot arrangement pattern and the lower step thereof or various noises specific to the printing apparatus can be dispersed. In reverse, it is possible to make loads applied to nozzles uneven therebetween by increasing the use frequency of a specific dot arrangement pattern.

As explained above, according to the present embodiment, the density information of an original image is reflected finally and at a stage where the dot arrangement patterning processing is completed, an arrangement of the dot data to the matrix (FIG. 4B) of the pixel areas in the print medium can be determined. That is, the nozzle array information composed of four bits to each area in the dot arrangement pattern is associated to the matrix (FIG. 4B) composed of the array resolution 1200 dpi in the nozzle arrangement direction and the print resolution 1200 dpi in the main scan direction.

Therefore, it is possible to determine what nozzle array is used to eject ink droplets, with a degree of freedom. For example, in the gradation levels of 1 to 3, the dot arrangement pattern can be, as described in Japanese Patent Laid-Open No. 2006-150811, selected such that the dots do not get in contact with each other before the dots are absorbed in the print medium. In printing with the gradation levels of 7 or more, which is close to a solid print, the dot arrangement pattern focusing more on density can be provided than on contact between the dots. In this way, to the ink droplet previously applied, a different ink droplet can be printed on the dot of the previous ink droplet to produce high gradation properties and high image density.

The dot data allocated for each nozzle array (having nozzle designation information) by the dot arrangement pattern as described above are sent to a head drive circuit (FIG. 5) of the image printing unit 37 (FIG. 3). In addition, in performing ejection from each nozzle array of the print head, the ejection timing is shifted corresponding to an interval between the nozzle arrays and the ink ejection is performed from each nozzle array.

Second Embodiment

In the dot arrangement patterns used in the first embodiment are, as shown in FIGS. 6A and 6B, four kinds of the dot arrangement patterns shown by signs (4n) to (4n+3) are circulated for use. Therefore, for example, in the upper areas in the dot arrangement patterns in regard to "level 1" in FIG. 6A, printing is performed using only the nozzle arrays of A array and B array in the main scan (X) direction. In addition, in the lower areas in the dot arrangement patterns in regard to the same "level 1", printing is performed using only the nozzle arrays of C array and D array in the main scan direction. In this case, for example, when the solid images in regard to level 1 are continuously formed, a use frequency of the used nozzle arrays becomes uneven to produce a deviation in durability of the print head.

Here, the number of the dot arrangement patterns for each gradation level is determined by the area number, the resolution in the nozzle arrangement direction and the resolution of the image data to be inputted to the dot arrangement patterning processing J0005. The number of areas is determined by the resolution in the nozzle arrangement direction, the resolution in the main scan direction and the resolution of the input image data. Specifically the number of areas is expressed by (resolution in the nozzle arrangement direction/resolution of input image data)×(resolution in the main scan direction/resolution of input image data). A number of dot arrangement patterns for equalizing the use frequency of the nozzle array is found by number of areas×(resolution in the nozzle arrangement direction/resolution of input image data)×integral multiple. Upon generalizing this, when pixel arrangement resolution of input image data is assumed as R(dpi), arrangement resolution of the nozzle array is assumed as Ry(dpi) and pixel area arrangement resolution in the main scan direction is assumed as Rx(dpi), the number of dot arrangement patterns N (pieces) can be expressed by $$N = n \times \frac{RxRy^2}{R^3} \quad \text{[Expression 1]}$$

($n$ = integral numbers of 1, 2, 3, ⋯)

As described above, in the present embodiment, in a case where the resolution in the nozzle arrangement direction is 1200 dpi, the resolution in the main scan direction is 1200 dpi, the resolution of the input image data is 600 dpi and the number of areas is four, the number of dot arrangement patterns is determined as multiple of 8. Thereby, the use frequency of the nozzle array can be uniform.

Figure 7:
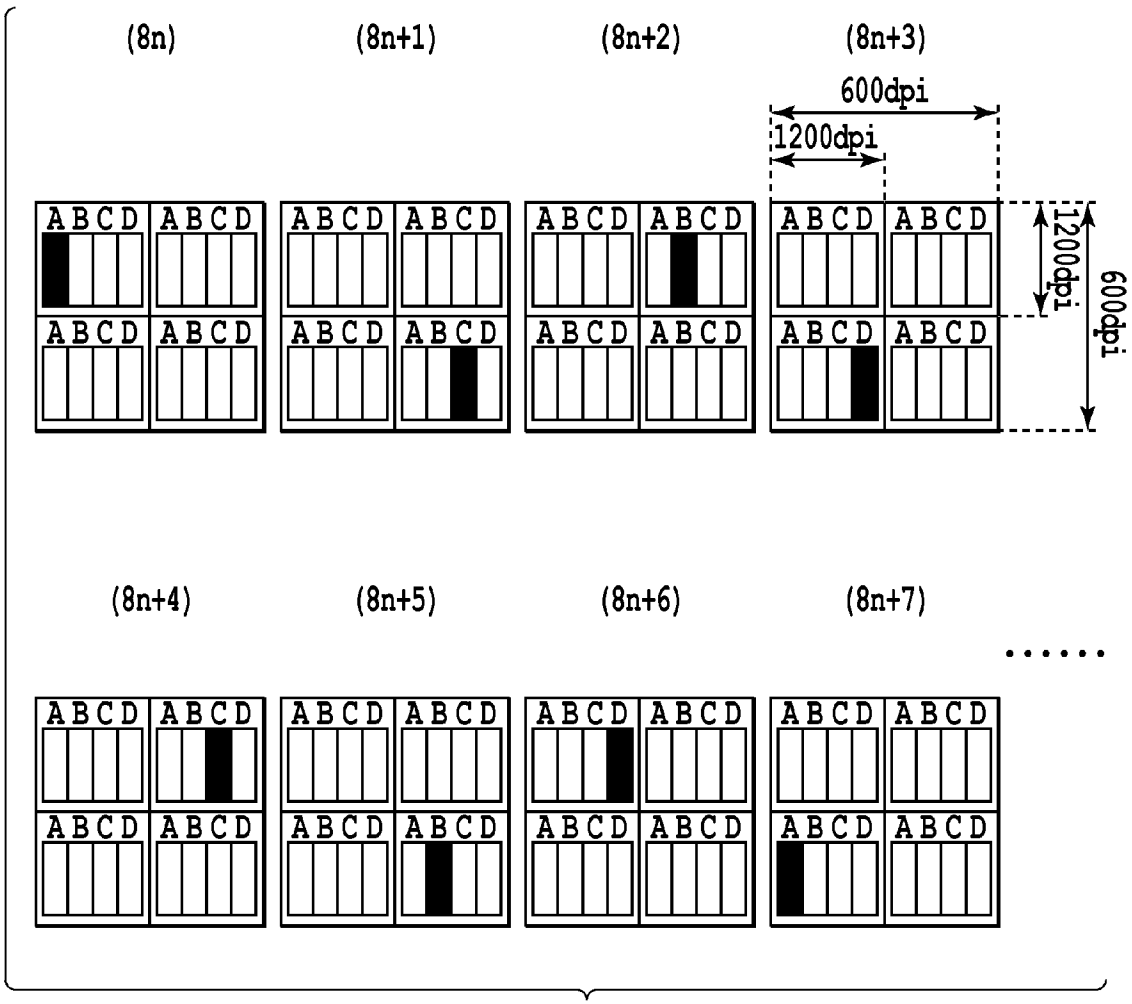
FIG. 7 is a diagram showing dot arrangement patterns according to a second embodiment of the present invention in regard to "level 1" in an example where the pattern number is eight.

FIG. 7 is a diagram showing dot arrangement patterns of "level 1" in an example where the number of dot arrangement patterns is 8, which is defined from the aforementioned condition. These dot arrangement patterns are the same as in the first embodiment other than the number of dot arrangement patterns for each gradation level. In the second embodiment of the present invention, eight kinds of the dot arrangement patterns shown in (8n) to (8n+7) are circulated for use at each gradation level. As apparent from FIG. 7, in the eight dot arrangement patterns sequentially used, the nozzle arrays composed of A array, B array, C array and D array each can be used one time at each of the upper area and the lower area. In this way, in addition to the advantageous effect explained in the first embodiment, particularly since the number of dot arrangement patterns is found by number of area×(resolution in the nozzle arrangement direction/pixel resolution of the half toning processing)×integral multiple, the effect of uniformity in use frequency of the nozzle arrays can be obtained.

Third Embodiment

A third embodiment of the present invention relates to an example where eight nozzle arrays are used in regard to one ink color and image data to be inputted to the dot arrangement patterning processing J0005 (FIG. 5) have 16 gradations of four bits.

Figure 8B:
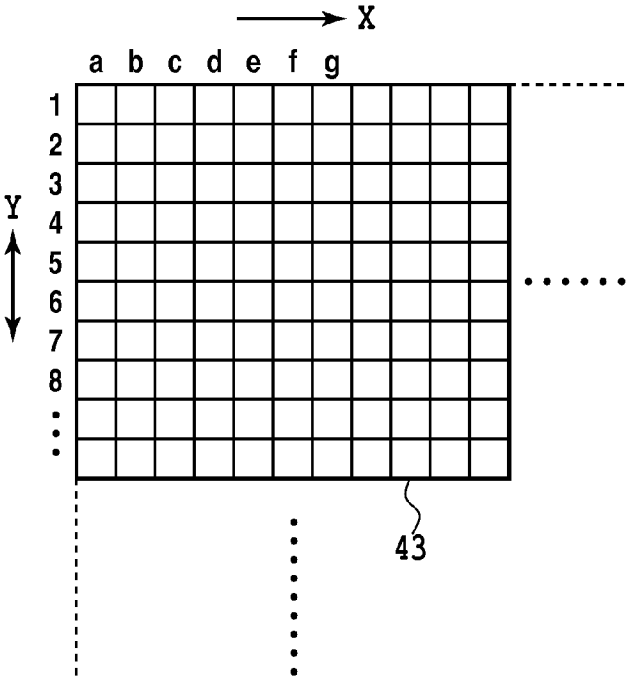
FIG. 8B is a diagram showing allocation of pixel areas corresponding to the above nozzle arrangement.
Figure 8A:
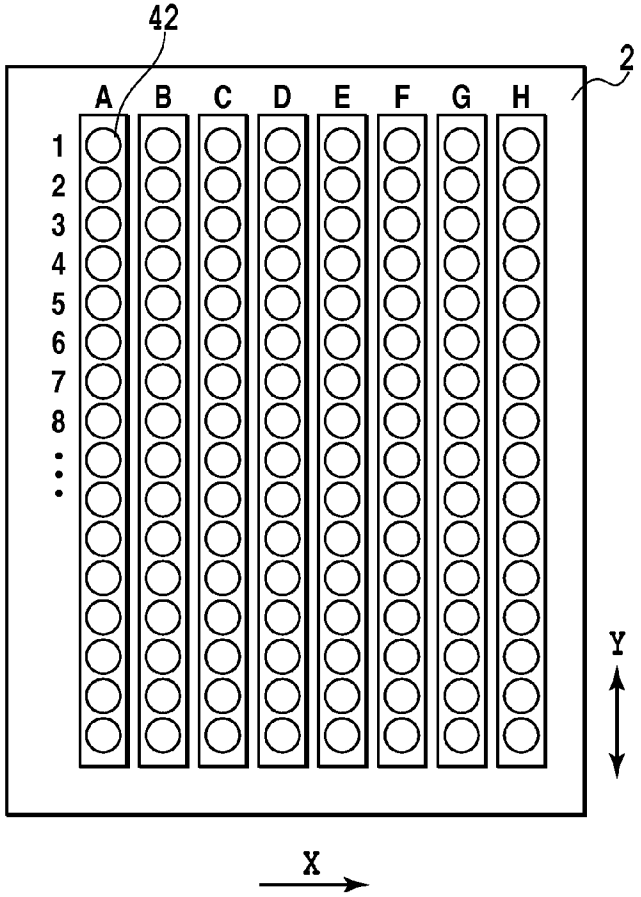
FIG. 8A is a diagram showing a nozzle array arrangement according to a third embodiment of the present invention.
Figure 9A:
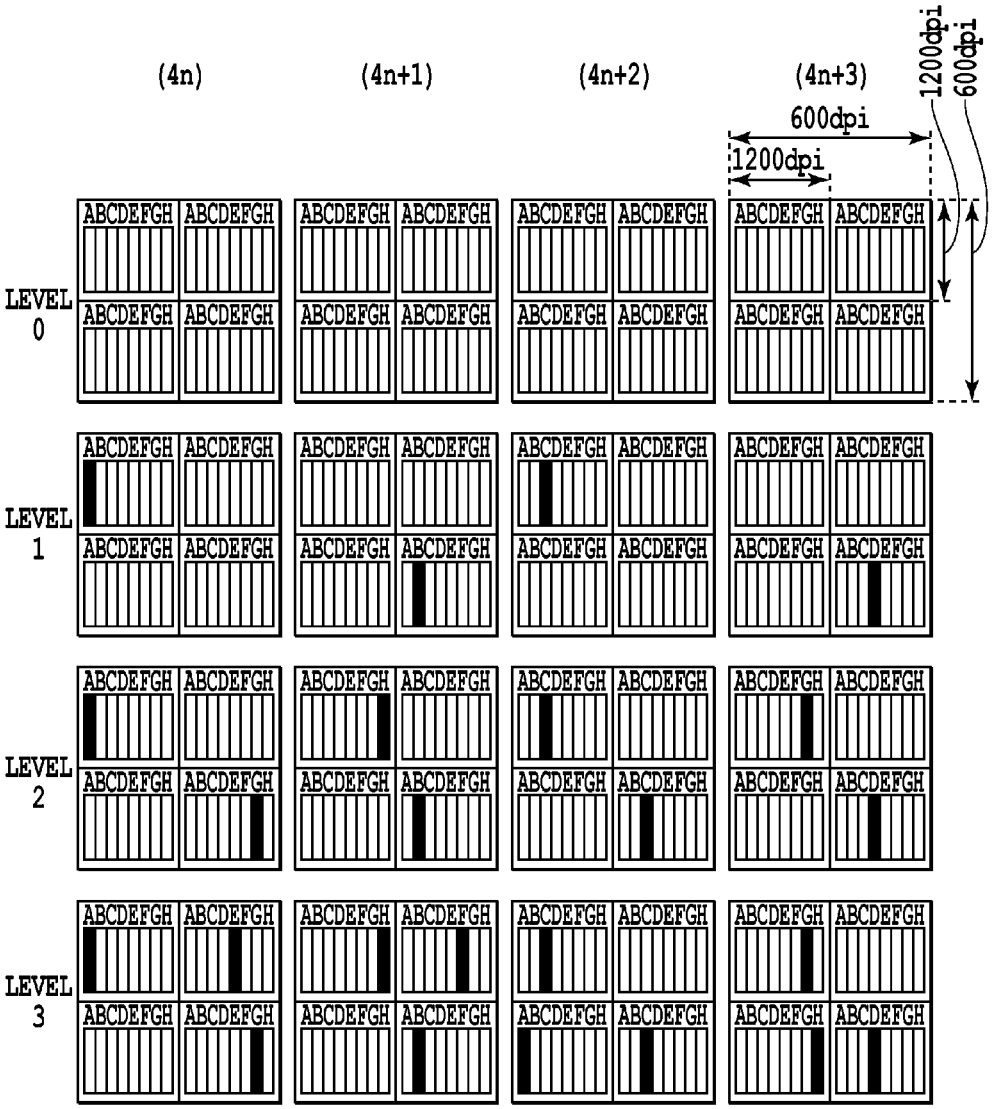
FIGS. 9A and 9B are diagrams showing dot arrangement patterns according to the third embodiment of the present invention.
Figure 9B:
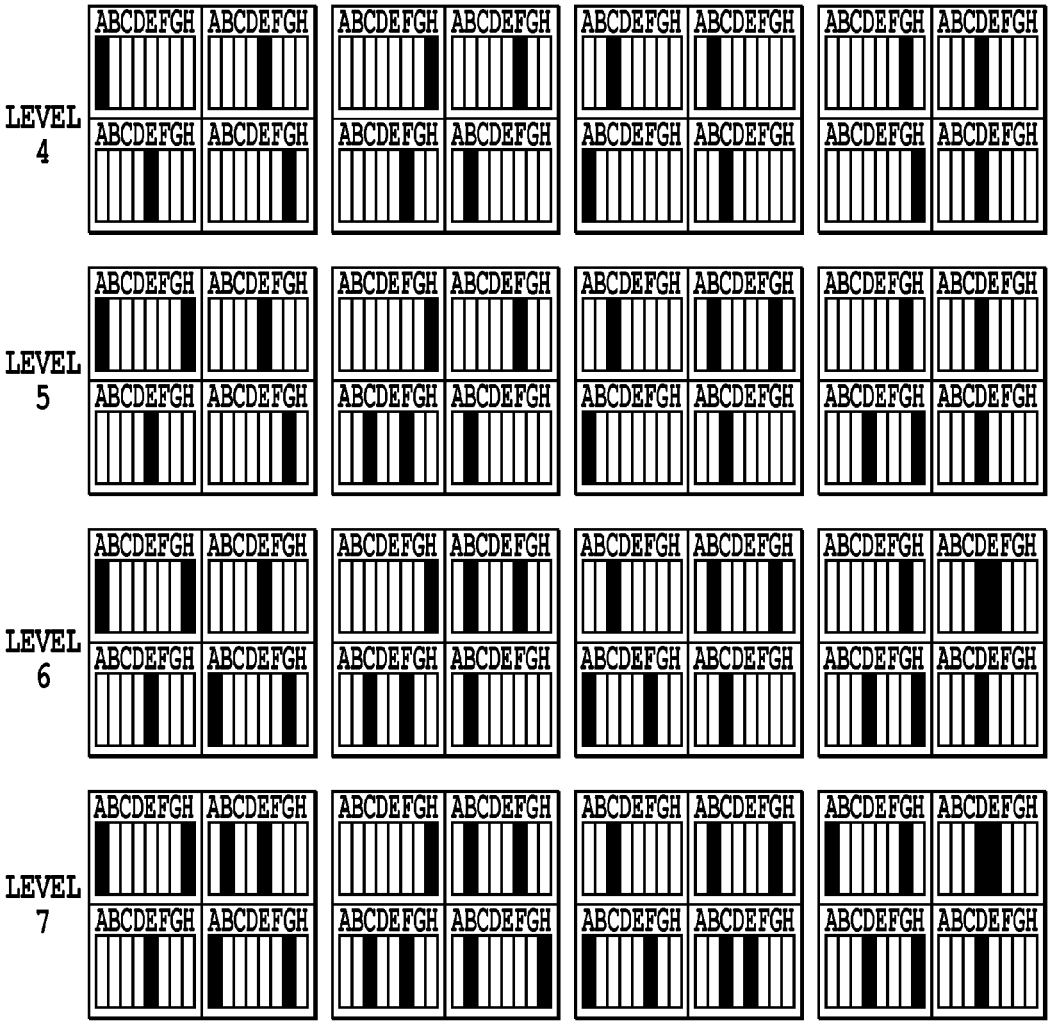
Figure 10A:
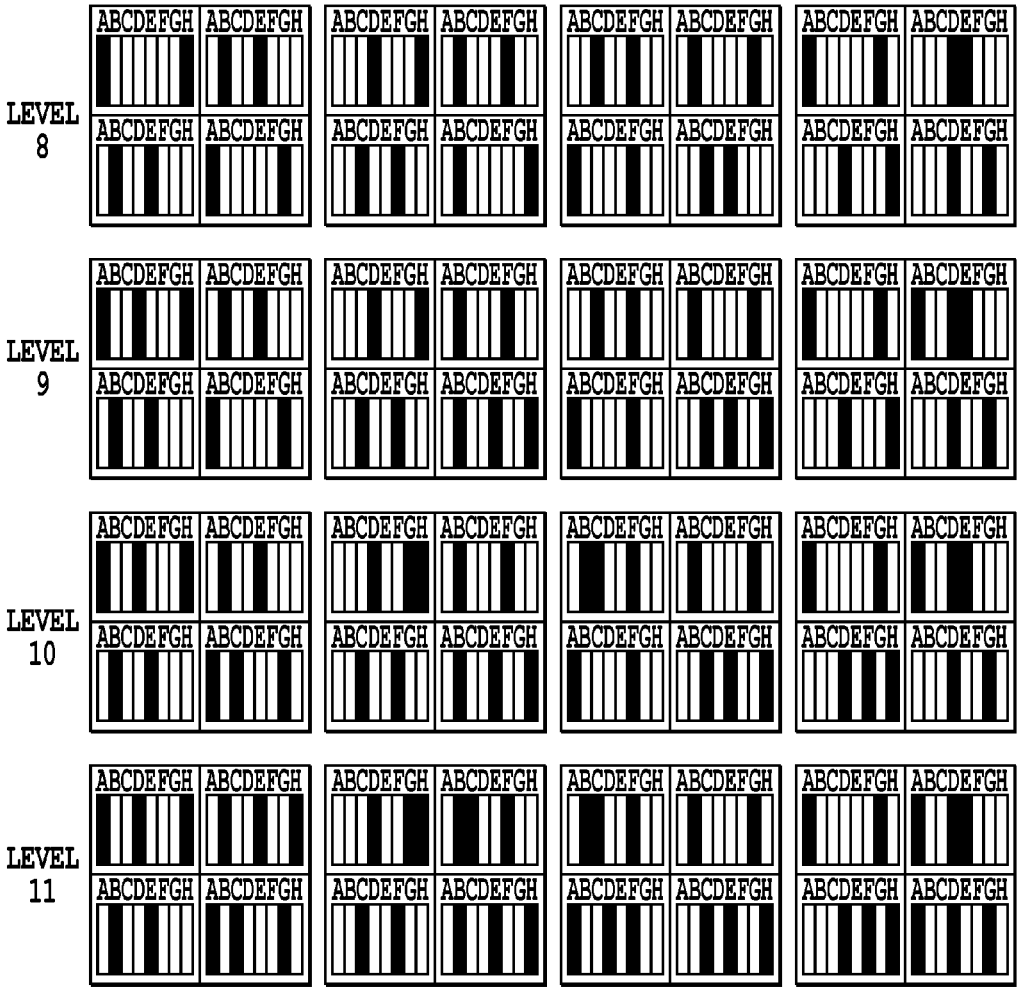
FIGS. 10A and 10B are diagrams showing dot arrangement patterns according to the third embodiment of the present invention.
Figure 10B:
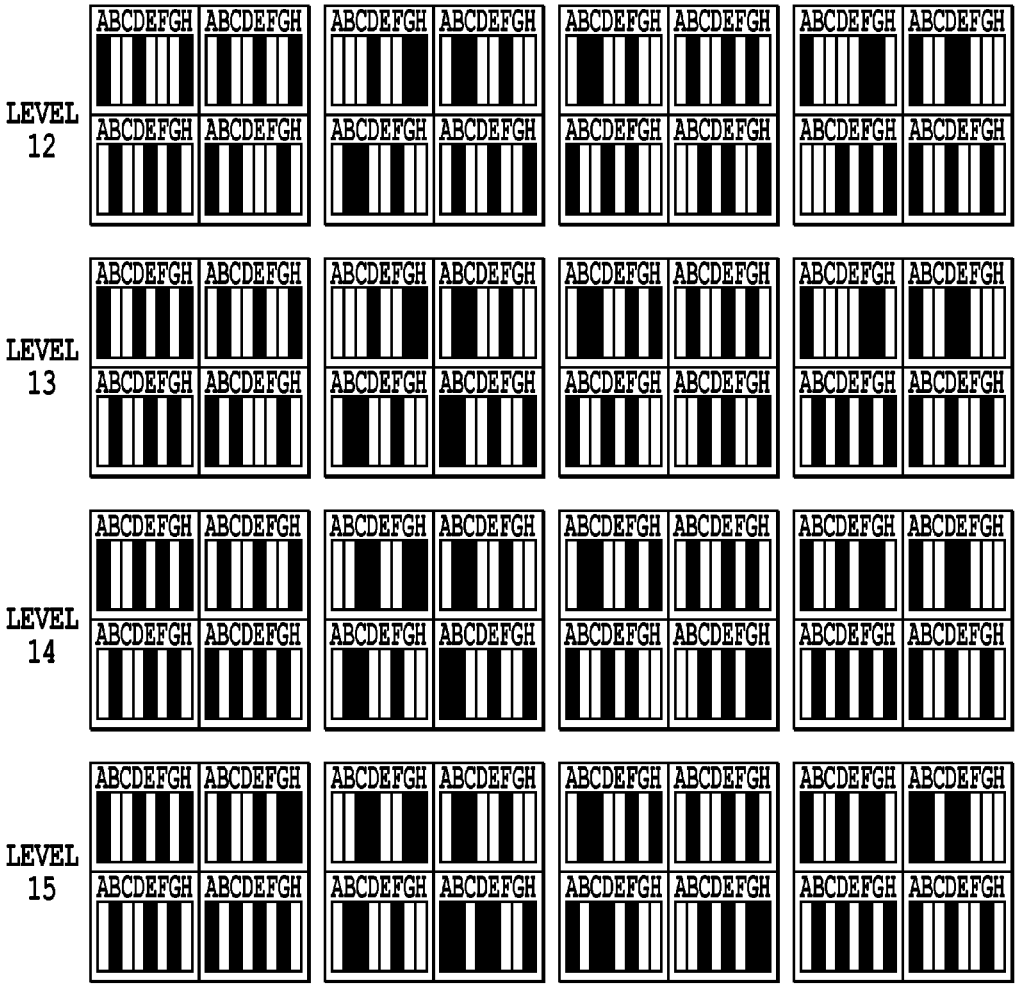

FIG. 8A is a diagram showing a nozzle array arrangement according to the present embodiment, and FIG. 8B is a diagram showing an arrangement of pixel areas corresponding to the nozzle array arrangement.

As shown in FIG. 8A, the print head 2 corresponding to one ink color includes eight arrays (A to H arrays) in each of which 969 pieces of nozzles 42 each ejecting ink having an ejection amount of 2.8 pl are arranged substantially in one line by an interval corresponding to 1200 dpi (interval of substantially 21.2 μm). In the full line type printing apparatus of the present embodiment, in regard to each ink color, the ink is ejected for printing to the print medium conveyed in the X direction relative to the print head, according to print data from each nozzle 42 of the eight nozzle arrays A to H of the print head 2. As shown in FIG. 8B, the pixel areas in the print medium on which ink is ejected from the nozzle for landing in are arrayed with resolution of 1200 dpi in the direction Y which is the same as the resolution in the nozzle array and likewise resolution of 1200 dpi in the X direction (main scan direction) to form a matrix 43 of the pixel areas. A binary data (dot data) is, as described later in FIGS. 9A, 9B and 10A, 10B, generated corresponding to each pixel area in the matrix.

The image data processing part 36 differs in the following point from each of the aforementioned embodiments. The half toning processing J0004 performs quantization of converting each of the color separation data of Y, M, C and K each having eight bits into each data of four bits. In the present embodiment, eight bit-data of 256 gradations are converted into four-bit data of 16 gradations with resolution of 600 dpi by using an error diffusion method. The four-bit data are data serving as an index for showing an arrangement pattern in the patterning processing in the dot arrangement in the printing apparatus. Next, in the dot arrangement patterning processing J0005, for each pixel expressed by four-bit data of the levels of 0 to 15 as output values from the half toning processing part, a dot arrangement pattern corresponding to a gradation value (levels of 0 to 15) of the pixel is assigned. Specially, corresponding to eight nozzle arrays, as described later in FIGS. 9*a*, 9B and 10A, 10B, eight bits are allocated to one area in the dot arrangement pattern, and A array, B array, C array, D array, E array, F array, G array, and H array are allocated to one area from the highest-order bit. As a result, in one area in the dot arrangement pattern, data for ejecting ink droplets of 0 to 8 droplets can be generated.

FIGS. 9A, 9B and 10A, 10B are diagrams showing dot arrangement patterns used in the dot arrangement patterning processing J0005 in the present embodiment. Specifically FIGS. 9A, 9B and 10A, 10B show dot arrangement patterns corresponding to each of gradation levels of 0 to 15 shown by four-bit data as input to the dot arrangement patterning processing J0005. The dot arrangement patterns shown in FIGS. 9A, 9B and 10A, 10B basically differ in a point where each area in one dot arrangement pattern has eight sub areas corresponding to eight nozzle arrays A to H from the patterns shown in FIGS. 6A and 6B.

According to the present embodiment, in the same way with each of the aforementioned embodiment, for example, in the gradation levels of 1 to 3, the dot arrangement pattern can be, as described in Japanese Patent Laid-Open No. 2006-150811, made such that the dots do not get in contact with each other before the dots are absorbed in the print medium. In printing of the gradation levels of 7 or more, which is close to a solid print, the dot arrangement pattern focusing more on density can be provided than on contact between the dots.

Fourth Embodiment

In the third embodiment, eight bits (eight nozzle arrays) are allocated to one area. On the other hand, in the fourth embodiment, four bits are allocated to one area and A array, B array, C array and D array are allocated to the one area from the highest-order bit and E array, F array, G array and H array are allocated to a different area. In consequence, ejection can be not made to the adjacent pixel areas from the same nozzle array.

Other Embodiment

Each of the aforementioned embodiments relates to an example in which the present invention is applied to the printing apparatus using the full line type print head, but the present invention may be applied to a printing apparatus using a serial type print head. That is, in a multi-pass system, information by what scan among plurality of times of scans printing is performed can be used as scan designation information for each area in the dot arrangement pattern. In the example shown in FIGS. 6A and 6B, sub areas A to D in each area correspond to first scan to fourth scan in the multi-pass printing of four passes. For example, in a case of using the dot arrangement pattern (4n) in "level 2", in the pixel area corresponding to area (r, c), dot formation is made by the first scan and in the pixel area corresponding to area (r+1, c+1), dot formation is made by the second scan. Then, based upon the dot data allocated to each scan by such dot arrangement pattern, ink is ejected to the corresponding pixel area from the nozzle corresponding to each pixel area. By applying the present invention to the multi-pass system as described above, particularly in a case of forming plurality of dots in the same position by different scans, the allocation of the dot data can be performed with a simple configuration.

As described above, the embodiments of the present invention moves printing elements such as nozzles relative to the print medium. That is, in the full line type, the print medium is conveyed relatively to the printing element array, and in the serial type, the print head provided with the printing element array scans the print medium. By carrying out such relative movement, the printing element is repeatedly opposed to the same pixel area of the print medium by plurality of times for forming a dot. That is, in the full line type, the plurality of printing element arrays arrayed in the relative movement direction (conveying direction) are sequentially opposed to the same pixel area. On the other hand, in the multi-pass system of a serial type, the printing element is opposed to the same area by plurality of times of scans. In these cases, the dot arrangement pattern holds information showing by what opposition among the plurality of times of the oppositions a dot is formed in a pixel area, corresponding to the pixel area, and in the dot data generation, dot data are generated using the dot arrangement pattern.

An application of the present invention is not limited to the printing apparatus of the inkjet system according to the aforementioned embodiment. It is apparent from the above description that the present invention can be applied to any printing system such as a thermal-transfer system as long as the print system forms a dot to perform a print. In this case, an element such as nozzles for forming a dot is called a printing element in the present specification.

Figure 11:
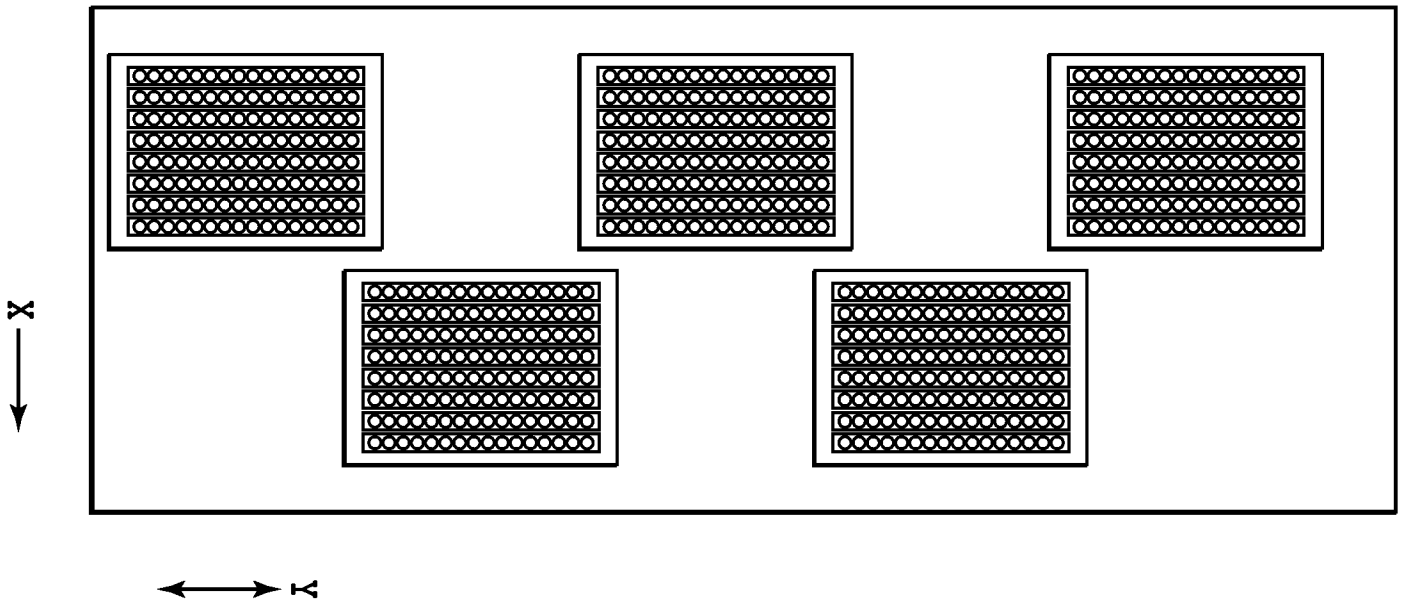
FIG. 11 is a diagram showing nozzle allocation of a print head according to another embodiment of the present invention.

The present embodiment explains the configuration where plurality of arrays are provided together in the print head as shown in FIG. 4A and FIG. 8A, but the present invention is not limited thereto. For example, as shown in FIG. 11, the present invention may be applied to a configuration where plurality of arrays are separated for each chip. Further, plurality of lines may be united in a chip or plurality of heads may be adopted by using one line as the print head.

The present embodiment adopts the configuration where, as shown in FIG. 6, FIG. 9 and FIG. 10, as the level number increases, information for performing a dot print is added based upon the earlier level number by one level number. However, the configuration not depending on the earlier level number by one level number, that is, the configuration of designating nozzles for performing a dot print at each level may be adopted.

Further, each of the aforementioned embodiment explains an example of using a single printing apparatus, but, for example, there may be adopted a configuration of a printing system where the processing until the dot arrangement patterning processing shown in FIG. 5 is executed by a personal computer, and the finally obtained dot data are sent to the printing apparatus for printing.

While the preset invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2009-150074, filed Jun. 24, 2009, which is hereby incorporated by reference herein in its entirety.

What is claimed is:

1. A printing apparatus that performs printing image on a print medium by carrying out a relative movement between printing elements for forming dots on the print medium and the print medium, said apparatus comprising:

a relative movement operating unit configured to carry out the relative movement so as to make the printing elements corresponding to the same color opposed to a same pixel area in a pixel of the print medium, on which a dot is formed, a plurality of times, a plurality of printing elements being sequentially opposed to the same pixel area; and a dot data generation unit configured to generate dot data used for printing dot on the print medium in the relative movement based on gradation levels of a plurality of image data of the image corresponding to a plurality of pixels by using a dot arrangement pattern representing an arrangement of dots in the pixel areas for each gradation level, the dot arrangement pattern determining whether or not to form dots for each pixel area and holding information for specifying which printing element is to be used for forming forms the dot on a pixel area in the plurality of printing elements.

2. The printing apparatus as claimed in claim 1, wherein the printing element has a form of a printing element array in which a plurality of printing elements are arrayed in a direction intersecting a direction of the relative movement and the information is information designating the printing element array for forming dot on the pixel area.

3. The printing apparatus as claimed in claim 2, wherein said dot data generation unit uses the dot arrangement pattern in accordance with the gradation level shown by the image data, and when pixel arrangement resolution of the image data is assumed as R(dpi), arrangement resolution of the printing element in the printing element array is assumed as Ry(dpi) and pixel area arrangement resolution in the relative movement direction is assumed as Rx(dpi), the number of dot arrangement patterns N (pieces) is shown by an expression below $$N = n \times \frac{RxRy^2}{R^3}$$

($n$ = integral numbers of 1, 2, 3, ⋯).

4. A printing apparatus that performs printing image on a print medium by carrying out a relative movement between printing elements for forming dots on the print medium and the print medium, said apparatus comprising:

a relative movement operating unit configured to carry out the plurality of times of the relative movements so as to make the printing elements corresponding to the same color opposed to a same pixel area in a pixel of the print medium, on which a dot is formed, plurality of times; and a dot data generation unit configured to generate dot data used for printing dot on the print medium in the relative movement based on gradation levels of a plurality of image data of the image corresponding to a plurality of pixels by using a dot arrangement pattern representing an arrangement of dots in the pixel areas for each gradation level, the dot arrangement pattern determining whether or not to form dots for each pixel area and holding information for specifying which relative movement is to be employed for forming the dot on a pixel area in the plurality of times of the relative movements.

5. A printing method for performing printing image on a print medium by carrying out a relative movement between printing elements for forming dots on the print medium and the print medium, said method comprising:

a step of carrying out the relative movement so as to make the printing elements corresponding to the same color opposed to a same pixel area in a pixel of the print medium, on which a dot is formed, a plurality of times, a plurality of printing elements being sequentially opposed to the same pixel area; and a dot data generation step of generating dot data used for printing dot on the print medium in the relative movement based on gradation levels of a plurality of image data of the image corresponding to a plurality of pixels by using a dot arrangement pattern representing an arrangement of dots in the pixel areas for each gradation level, the dot arrangement pattern determining whether or not to form dots for each pixel area and holding information for specifying which printing element is to be used for forming the dot on a pixel area in the plurality of printing elements.

6. The printing method as claimed in claim 5, wherein the printing element has a form of a printing element array in which a plurality of printing elements are arrayed in a direction intersecting a direction of the relative movement and the information is information designating the printing element array for forming dot on the pixel area.

7. The printing method as claimed in claim 6, wherein said dot data generation step uses the dot arrangement pattern in accordance with the gradation level shown by the image data, and when pixel arrangement resolution of the image data is assumed as R(dpi), arrangement resolution of the printing element in the printing element array is assumed as Ry(dpi) and pixel area arrangement resolution in the relative movement direction is assumed as Rx(dpi), the number of dot arrangement patterns N (pieces) is shown by an expression below $$N = n \times \frac{RxRy^2}{R^3}$$

($n$ = integral numbers of 1, 2, 3, ⋯).

8. A printing system that performs printing image on a print medium by carrying out a relative movement between printing elements for forming dots on the print medium and the print medium, said system comprising:

a relative movement operating unit configured to carry out the relative movement so as to make the printing elements corresponding to the same color opposed to a same pixel area in a pixel of the print medium, on which a dot is formed, a plurality of times, a plurality of printing elements being sequentially opposed to the same pixel area; and a dot data generation unit configured to generate dot data used for printing dot on the print medium in the relative movement based on gradation levels of a plurality of image data of the image corresponding to a plurality of pixels by using a dot arrangement pattern representing an arrangement of dots in the pixel areas for each gradation level, the dot arrangement pattern determining whether or not to form dots for each pixel area and holding information for specifying which printing element is to be used for forming the dot on a pixel area, in the plurality of printing elements.

* * * * *